US009350089B2

(12) United States Patent
Kato et al.

(10) Patent No.: US 9,350,089 B2
(45) Date of Patent: May 24, 2016

(54) CONNECTION STRUCTURE OF BUS BAR AND TERMINAL

(71) Applicant: YAZAKI CORPORATION, Minato-ku, Tokyo (JP)

(72) Inventors: Hiroyuki Kato, Kakegawa (JP); Yutaka Wakatsuki, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 164 days.

(21) Appl. No.: 14/172,506

(22) Filed: Feb. 4, 2014

(65) Prior Publication Data

US 2014/0227916 A1 Aug. 14, 2014

(30) Foreign Application Priority Data

Feb. 8, 2013 (JP) ..... 2013-022834

(51) Int. Cl.
*H01R 4/10* (2006.01)
*H01R 4/18* (2006.01)
*H01R 25/16* (2006.01)

(52) U.S. Cl.
CPC ..... *H01R 4/186* (2013.01); *H01R 4/188* (2013.01); *H01R 25/162* (2013.01)

(58) Field of Classification Search
CPC .... H01R 13/187; H01R 23/727; H01R 13/20; H01R 13/15; H01R 13/115; H01R 13/111; H01R 13/113; H01R 4/185; H01R 4/188; H01R 4/20
USPC ..... 439/843–847, 850–852, 877, 882; 174/84 C
See application file for complete search history.

(56) References Cited

U.S. PATENT DOCUMENTS 3,568,137 A * 3/1971 Youngblut ..... H01R 4/18 439/865
3,654,594 A * 4/1972 Sitzler ..... H01R 4/185 439/857
5,484,305 A * 1/1996 Diniz ..... H01R 4/2495 174/84 C
5,733,154 A * 3/1998 Libregts ..... H01R 4/182 439/850

(Continued)

FOREIGN PATENT DOCUMENTS

CN 102414871 A 4/2012
JP 2012-59658 A 3/2012

OTHER PUBLICATIONS

Communication dated Nov. 4, 2015 from the State Intellectual Property Office of the P.R. China issued in corresponding Chinese application No. 201410046100.8.

*Primary Examiner* — Thanh Tam Le
(74) *Attorney, Agent, or Firm* — Sughrue Mion, PLLC

(57) ABSTRACT

By forming a bus bar-swaging part at a terminal, forming a bus bar-crimping part at a bus bar, and providing a crimping posture-retaining part that retains the crimping posture of the bus bar-crimping part when crimping the bus bar-swaging part to the bus bar-crimping part, the present invention provides a connection structure capable of preventing defective crimping caused by the change in the posture of the bus bar-crimping part to thereby enhance the reliability on connection.

5 Claims, 9 Drawing Sheets

(56) References Cited

U.S. PATENT DOCUMENTS 7,115,004 B2 * 10/2006 Takayama ..... H01R 4/185 439/850
7,252,559 B1 * 8/2007 Morello ..... H01R 4/185 439/843
7,442,098 B2 * 10/2008 Uchida ..... H01R 13/055 439/877
7,445,529 B2 * 11/2008 Takizawa ..... H01R 11/01 439/845
7,494,388 B2 * 2/2009 Kakuta ..... H01R 4/185 439/877
7,556,541 B2 * 7/2009 Tyler ..... H01R 13/03 439/843
7,896,715 B2 * 3/2011 Kumakura ..... H01R 4/185 439/442
8,602,831 B2 * 12/2013 Miyawaki ..... H01R 12/57 439/877
8,870,611 B2 * 10/2014 Sato ..... H01R 4/188 439/442

* cited by examiner

CONNECTION STRUCTURE OF BUS BAR AND TERMINAL

BACKGROUND OF THE INVENTION

1. Field of the Invention

The present invention relates to a connection structure of a bus bar and an electric wire, in particular, to a connection structure of a bus bar and an electric wire for use in a power supply device to be mounted in electric vehicles or hybrid vehicles.

2. Related Background of the Invention

In electric vehicles that run using an electric motor, or in hybrid vehicles that run in the combined use of an electric motor and an engine, in order to achieve smooth running, there is required a power supply device that supplies a high voltage and high output power to the electric motor. As a power supply device for this, a power supply device of a structure in which a plurality of battery cells is connected in series is used.

In Patent Document 1, such a power supply device is described. The power supply device includes a battery module in which a positive electrode and a negative electrode are provided at an end of a battery cell and a plurality of battery cells is stacked side by side in a state where the positive electrode and the negative electrode are adjacent to each other, and a bus bar module housing a plurality of bus bars connecting between the plurality of battery cells of the battery module and between the battery cell and an external apparatus.

Positive electrodes and negative electrodes of battery cells adjacent to each other are fitted into the bus bar, and thus the bus bar connects the plurality of battery cells in series. It is configured such that, by connecting terminals of an electric wire (voltage-detecting wire) to the bus bar, potentials of respective battery cells and the voltage of the battery module can be measured.

The connection structure of the bus bar and the electric wire described in Patent Document 1 is a structure in which an electric wire is co-crimped on the bus bar by using a terminal. That is, a bus bar-crimping part in a flat plate shape is formed in the bus bar and a bus bar-swaging part of a terminal is swaged and crimped in a state where the bus bar-crimping part and the core wire of an electric wire are in contact with each other, and thus the bus bar and the electric wire are connected with each other.

PRIOR ART DOCUMENT

Patent Document

[Patent Document 1] Japanese Patent Application Laid-Open Publication No. 2012-59658

SUMMARY OF THE INVENTION

In the connection structure described in Patent Document 1, since the bus bar-crimping part is in a flat plate shape, the posture of the bus bar-crimping part relative to the bus bar-swaging part changes into an inclined state when the bus bar-swaging part of a terminal is swaged. When the posture of the bus bar-crimping part is inclined, an unstable contact state is brought about. Furthermore, when crimping is carried out in a state where the inclination is generated, there is caused defective crimping in which a left-and-right pair of side walls of the bus bar-swaging part are not crimped uniformly to the bus bar-crimping part. Consequently, insufficient contact pressure, biting or the like is generated and there is caused a problem of lowering of reliability on the connection between the bus bar and the electric wire.

Accordingly, the present invention aims at providing a connection structure of the bus bar and the electric wire, which can prevent the defective crimping caused by the change in the posture of the bus bar-crimping part at the time of swaging, to thereby enhance the reliability on the connection.

The connection structure of the present invention is a connection structure of a bus bar and a terminal for electrically connecting a bus bar that connects apparatuses with each other, with a terminal of an electric wire end. The bus bar is formed of a bus bar main body that connects apparatuses with each other, and a bus bar-crimping part which is formed integrally with the bus bar main body, and to which the terminal is connected in a crimped manner, the terminal being formed of an electric wire connection part to which an electric wire end is connected and a bus bar-swaging part to be connected to the bus bar-crimping part. The connection structure of the present invention is characterized in that a crimping posture-retaining part for retaining a crimping posture of the bus bar-crimping part when crimping the bus bar-swaging part to the bus bar-crimping part is provided at the bus bar-crimping part.

In the connection structure of the present invention, the bus bar-swaging part is preferably formed of an arc-shaped bottom wall and a pair of side walls that are provided extending from both side parts of the bottom wall in the same direction and that are bent in a mutually approaching direction when swaging the bus bar-crimping part to encompass the bus bar-crimping part. Here, the crimping posture-retaining part is preferably a posture-retaining face that is provided at the bus bar-crimping part and that is supported by at least one of the pair of side walls when swaging the bus bar-swaging part to the bus bar-crimping part.

In the connection structure of the present invention, the posture-retaining face is preferably a flat face or a curved face that makes surface-contact with at least one of the pair of side walls.

In the connection structure of the present invention, preferably, the bus bar-crimping part is formed in a U-letter shape by a base part provided extending from the bus bar main body, a one-side contact piece that is provided extending from the base part to make contact with one side wall of the pair of side walls, an other-side contact piece that makes contact with the other side wall, and a coupling-contact piece that couples the one-side contact piece and the other-side contact piece, and the posture-retaining face is formed on at least the coupling-contact piece.

In the connection structure of the present invention, preferably, the bus bar-crimping part is formed in a plate shape, and at the side-face part of the bus bar-crimping part in a plate shape, the posture-retaining face that makes surface-contact with the pair of side walls when swaging the bus bar-swaging part to the bus bar-crimping part is formed.

DESCRIPTION OF THE PREFERRED EMBODIMENTS

Figure 1:
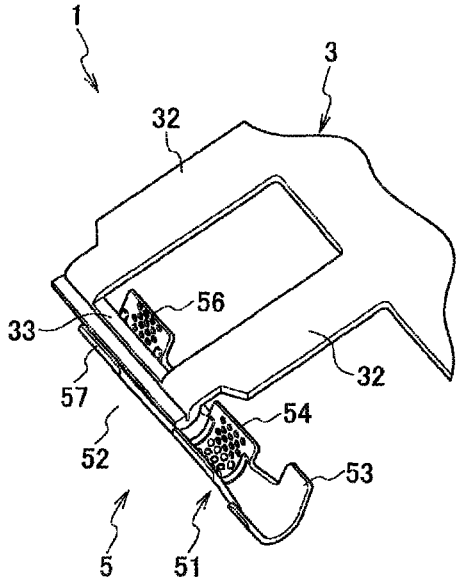
FIG. 1 is a perspective view showing the connection structure of a first embodiment of the present invention.

Hereinafter, the present invention will be explained specifically by embodiments illustrating the present invention. Meanwhile, respective embodiments are associated with each other with the same reference numeral being attached to the same member.

<First Embodiment>

Figure 2:
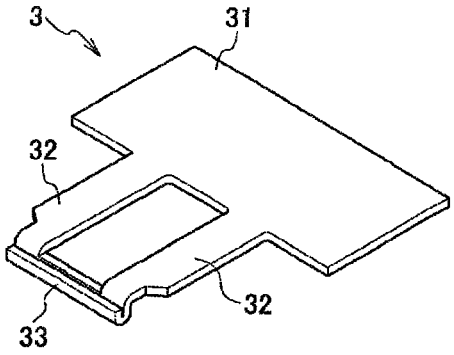
FIG. 2 is a perspective view of the bus bar for use in the first embodiment.
Figure 3:
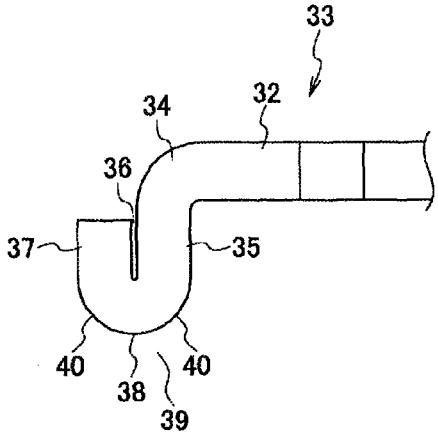
FIG. 3 is an end view showing the bus bar-crimping part of the first embodiment.
Figure 4:
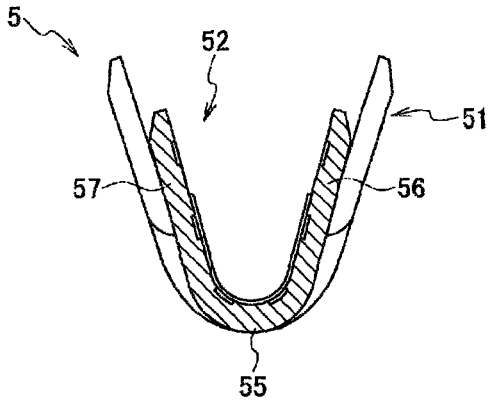
FIG. 4 is a cross-sectional view showing the terminal of the first embodiment.

FIG. 1 to FIG. 4 show the connection structure of a first embodiment of the present invention. FIG. 1 is a perspective view showing an entire connection structure 1, FIG. 2 is a perspective view of a bus bar 3, FIG. 3 is an end view showing a crimping part of the bus bar 3, and FIG. 4 is a cross-sectional view of a terminal 5.

The connection structure 1 is a connection structure that connects the bus bar 3 with the terminal 5, and used, for example, for connecting a power supply device with a voltage-detecting device of electric vehicles and hybrid vehicles. In this case, the bus bar connects in series positive electrodes or negative electrodes protruding from each of a plurality of battery cells stacked side by side in the power supply device, the illustration of which is omitted. To the terminal 5, for example, an end of an electric wire from a voltage-detecting device, the illustration of which is omitted, is connected.

As shown in FIG. 1 and FIG. 3, the bus bar 3 is formed of a bus bar main body 31 in a flat-plate shape of a rectangle etc. and a bus bar-crimping part 33 formed integrally for a connection end 32 provided extending from the bus bar main body 31. The bus bar main body 31 connects a plurality of battery cells as devices with each other. A pair of connection ends 32 is provided extending from the bus bar main body 31, and the bus bar-crimping part 33 is laid across the pair of connection ends 32.

As shown in FIG. 3, the bus bar-crimping part 33 of the present embodiment is formed of a base part 34 provided extending from the connection end 32, a one-side contact piece 35 provided extending from the base part 34 while being bent downward, an other-side contact piece 37 facing the one-side contact piece 35 in a state of being parallel to the one-side contact piece 35 with a gap part 36 interposed, and a coupling-contact piece 38 including a curved face that couples the one-side contact piece 35 and the other-side contact piece 37. The whole of the one-side contact piece 35, the other-side contact piece 37 and the coupling-contact piece 38 is in a U-letter shape.

In order to form the bus bar-crimping part 33, the one-side contact piece 35 and the other-side contact piece 37 are formed integrally with the bus bar main body 31, next, the other-side contact piece 37 is bent at the portion of the coupling-contact piece 38 so as to make close contact with the one-side contact piece 35, and 90-degree bending is carried out relative to the bus bar main body 31 at the portion of the base part 34 so that the one-side contact piece 35 is bent downward. After that, the one-side contact piece 35 and the other-side contact piece 37 are opened from the close contact state, to thereby form the gap part 36, and thus they are formed into a U-letter shape.

As shown in FIG. 1, the terminal 5 is formed of an electric wire-connection part 51 and a bus bar-swaging part 52. The electric wire-connection part 51 is one to which an electric wire end is to be connected, and is integrally formed of a coating connection part 53 to be coupled to an insulating coating of an electric wire by cramping, pressure contact or the like and a core wire-connection part 54 to be connected to a core wire of an electric wire by crimping, pressure contact, ultrasonic bonding or the like.

The bus bar-swaging part 52 is to be connected to the bus bar-crimping part 33 of the bus bar 3, and is formed by extending integrally from the tip side of the electric wire connection part 51. As shown in FIG. 4, the bus bar-swaging part 52 has a bottom wall 55 in an arc shape, and a pair of side walls including a one-side side wall 56 and the other-side side wall 57 provided extending from both side parts of the bottom wall 55 in the same direction, and the whole thereof is in a U-letter shape. The pair of side walls 56 and 57 is bent in a mutually approaching direction when swaging the bus bar-swaging part 52 to the bus bar-crimping part 33 of the bus bar 3, to thereby encompass the bus bar-crimping part 33. At this time, chip parts of the pair of side walls 56 and 57 being bent enter the gap part 36 of the bus bar-crimping part 33.

In the above embodiment, at the bus bar-crimping part 33, a crimping posture-retaining part 39 is formed. The crimping posture-retaining part 39 retains the crimping posture of the bus bar-crimping part 33 when crimping the bus bar-swaging part 52 of the terminal 5 to the bus bar-crimping part 33 of the bus bar 3. In the present embodiment, the crimping posture-retaining part 39 is formed of the posture-retaining face 40 that provides continuously the coupling-contact piece 38 and the contact piece 35 or 37 in the bus bar-crimping part 33, and the posture-retaining face 40 has a curved face. In the present embodiment, the posture-retaining face 40 is formed with respect to both the one-side contact piece 35 and the other-side contact piece 37, but the posture-retaining face 40 may be a curved face on the one-side contact piece 35 side or may be a curved face on the other-side contact piece 37 side.

Next, the operation of connecting the bus bar 3 with the terminal 5 according to the present embodiment will be explained. As shown in FIG. 1, the terminal 5 is arranged to the bus bar 3 so that the bus bar-swaging part 52 is positioned on the lower side relative to the bus bar-crimping part 33. At this time, the bus bar-swaging part 52 is positioned so that the pair of side walls 56 and 57 sandwich the bus bar-crimping part 33. Then, using a crimping jig (illustration is omitted), the bus bar-swaging part 52 is swaged to the bus bar-crimping part 33.

In the swaging, both the side walls 56 and 57 or at least either the side wall 56 or side wall 57, in the bus bar-swaging part 52 makes contacts with the posture-retaining face 40 of the bus bar-crimping part 33. That is, the one-side side wall 56 and the other-side side wall 57 of the bus bar-swaging part 52 make surface-contact with posture-retaining faces 40 of respective contact pieces 35 and 37. Alternatively, the inner face of the one-side side wall 56 of the bus bar-swaging part 52 makes surface-contact with the posture-retaining face 40 on the one-side contact piece 35 side of the bus bar-crimping part 33, or the other-side side wall 57 of the bus bar-swaging part 52 makes surface-contact with the posture-retaining face 40 on the other-side contact piece 37 side of the bus bar-crimping part 33.

In such surface contact, the posture of the bus bar-crimping part 33 in the swaging can be retained and contact properties of the bus bar-crimping part 33 with the bus bar-swaging part 52 can be enhanced. Therefore, the inclination of the bus bar-crimping part 33 at the time of the swaging can be prevented and poor contact pressure and biting caused by the inclination are avoided. Consequently, the reliability on the connection can be enhanced.

In the connection structure 1 of the present invention, since the crimping posture-retaining part 39 for retaining the crimping posture of the bus bar-crimping part 33 at the time of crimping the bus bar-swaging part 52 to the bus bar-crimping part 33 is provided for the bus bar-crimping part 33, the crimping posture of the bus bar-crimping part 33 is not inclined in the swaging of the bus bar-swaging part 52, and defective crimping such as poor contact pressure or biting is prevented. Therefore, the reliability on the connection is enhanced.

Furthermore, the crimping posture-retaining part 39 is formed of the posture-retaining face 40 that is supported by at least one of the pair of side walls of the bus bar-crimping part 33 (the one-side contact piece 35, the other-side contact piece 37) at the time of swaging the bus bar-swaging part 52 to the bus bar-crimping part 33, and the posture-retaining face 40 prevents the inclination of the bus bar-crimping part 33 in swaging the bus bar-swaging part 52. Consequently, defective crimping such as poor contact pressure or biting is prevented and thus the reliability on the connection is enhanced.

<Second Embodiment>

Figure 5A:
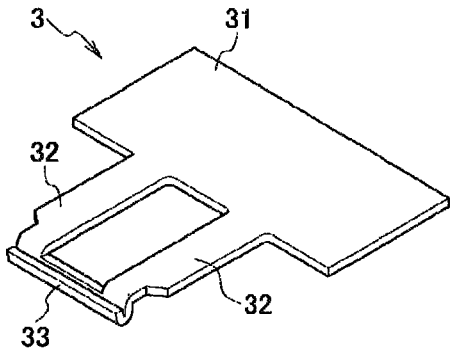
FIG. 5A is a perspective view of the bus bar of a second embodiment of the present invention.
Figure 5B:
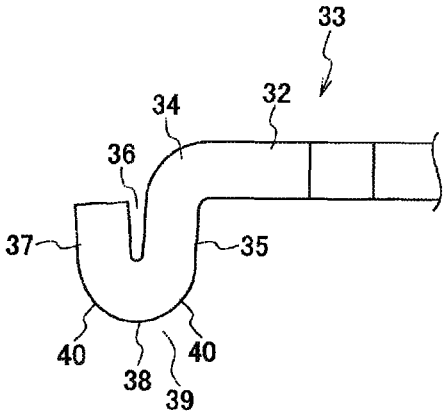
FIG. 5B is an end view of the bus bar-crimping part of the second embodiment of the present invention.

FIG. 5A and FIG. 5B show the bus bar 3 in a second embodiment of the present invention. FIG. 5A is a perspective view of the bus bar 3 of the second embodiment of the present invention, and FIG. 5B is an end view of the bus bar-crimping part 33 of the second embodiment of the present invention. As shown in FIG. 5A, in the bus bar 3, the bus bar-crimping part 33 is formed integrally, via the connection end 32, with respect to the bus bar main body 31 in a flat plate shape.

The bus bar-crimping part 33 is formed, as shown in FIG. 5B, by coupling the one-side contact piece 35 and the other-side contact piece 37 with the coupling-contact piece 38, and the gap part 36 between the one-side contact piece 35 and the other-side contact piece 37 is made wider than the gap part 36 in the first embodiment (see FIG. 3).

In order to form the bus bar-crimping part 33, the one-side contact piece 35 and the other-side contact piece 37 are formed integrally with the bus bar main body 31, next, the other-side contact piece 37 is bent at the portion of the coupling-contact piece 38 so as to contact closely with the one-side contact piece 35, and furthermore, there is carried out 90-degree bending relative to the bus bar main body 31 at the portion of the base part 34 so that the one-side contact piece 35 is bent downward. After that, from a state where the one-side contact piece 35 and the other-side contact piece 37 contact closely with each other, the one-side contact piece 35 and the other-side contact piece 37 are opened to form the gap part 36. Therefore, they are formed into a V-letter shape. Also in this embodiment, in the same way as in the first embodiment, the crimping posture-retaining part 39 is formed.

The crimping posture-retaining part 39 is formed of the posture-retaining face 40 including a curved face on which the coupling-contact piece 38 and the contact piece 35 or 37 are continuously provided. The posture-retaining face 40 includes the curved face of both the one-side contact piece 35 and the other-side contact piece 37, but the posture-retaining face 40 may be a curved face on the one-side contact piece 35 side, or may be a curved face on the other-side contact piece 37 side. Consequently, when swaging the bus bar-swaging part 52, at least either the side wall 56 or the side wall 57 in the bus bar-swaging part 52 makes surface-contact with the posture-retaining face 40 of the bus bar-crimping part 33, and thus the posture of the bus bar-crimping part 33 can be retained, and contact properties of the bus bar-crimping part 33 with the bus bar-swaging part 52 can be enhanced. Accordingly, the inclination of the bus bar-crimping part 33 in the swaging can be prevented and poor contact pressure and biting caused by the inclination are avoided. Consequently, the reliability on the connection can be enhanced.

<Third Embodiment>

Figure 6A:
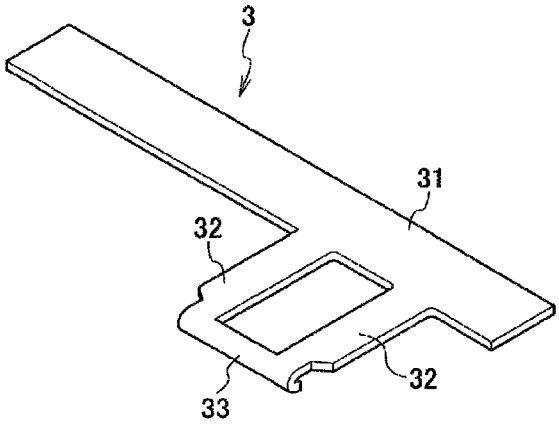
FIG. 6A is a perspective view of the bus bar of a third embodiment of the present invention.
Figure 6B:
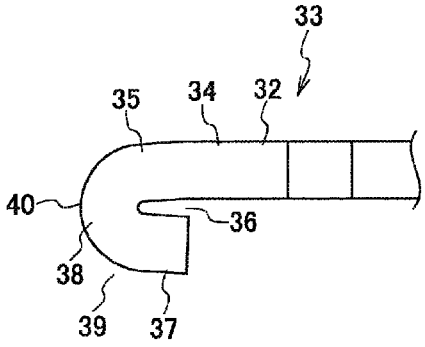
FIG. 6B is an end view of the bus bar-crimping part of the third embodiment of the present invention.

FIG. 6A and FIG. 6B show the bus bar 3 in a third embodiment of the present invention. FIG. 6A is a perspective view of the bus bar 3 of the third embodiment of the present invention, and FIG. 6B is an end view of the bus bar-crimping part 33 of the third embodiment of the present invention.

As shown in FIG. 6B, the one-side contact piece 35 is formed by extending, in a plane direction, the base part 34 which is provided extending from the connection end 32, bending of the tip part of the one-side contact piece 35 in a U-letter shape forms the coupling-contact piece 38, and by bending the coupling-contact piece 38, the other-side contact piece 37 is continuously provided. Consequently, the gap part 36 is formed between the contact pieces 35 and 37. The coupling-contact piece 38 is formed of a curved face of a U-letter shape or a V-letter shape, and the curved face serves as the posture-retaining face 40. When swaging the bus bar-swaging part 52, either the side wall 56 or the side wall 57 of the bus bar-swaging part 52 makes surface-contact with the posture-retaining face 40 of the coupling-contact piece 38. As the result of this contact, the bus bar-crimping part 33 can retain the connection to thereby enhance contact properties of the bus bar-crimping part 33 with the bus bar-swaging part 52. Accordingly, at the time of the swaging, the inclination of the bus bar-crimping part 33 can be prevented and poor contact pressure and biting caused by the inclination are avoided. Consequently, the reliability on the connection can be enhanced.

<Fourth Embodiment>

Figure 7:
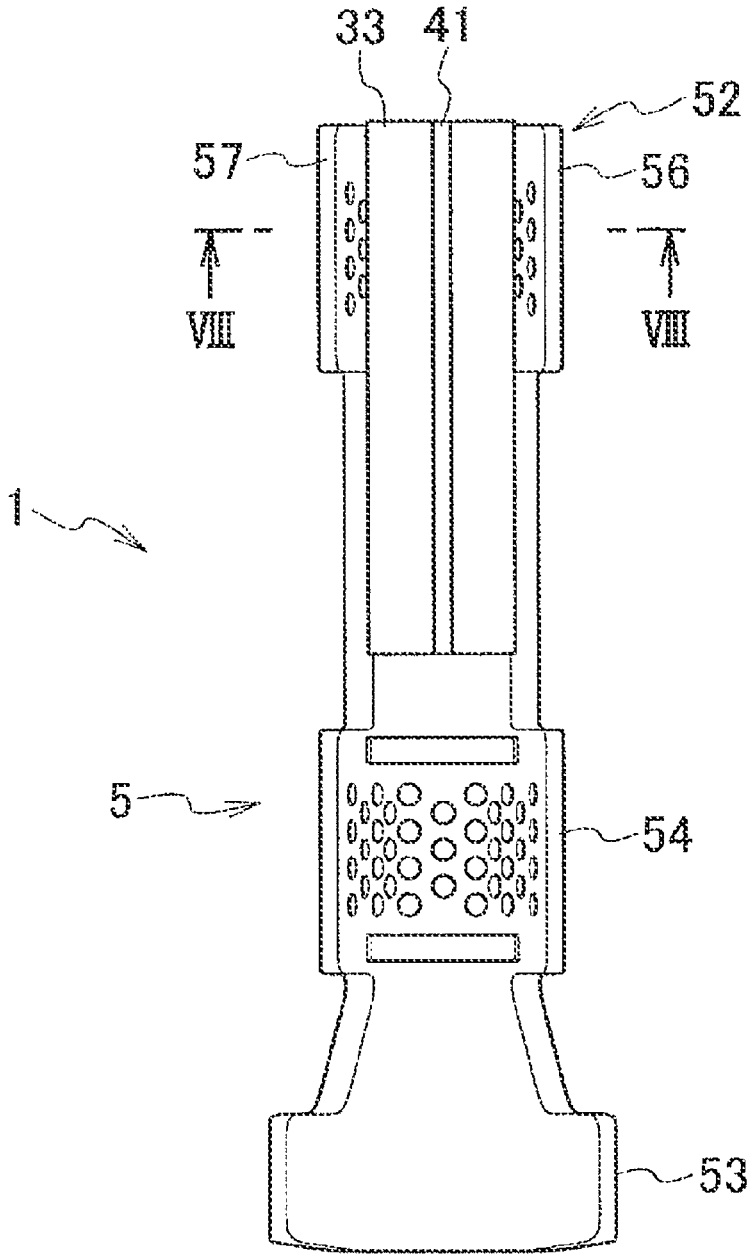
FIG. 7 is a plan view showing a state where the bus bar-crimping part is disposed at the bus bar-swaging part of a terminal in a fourth embodiment of the present invention.
Figure 8A:
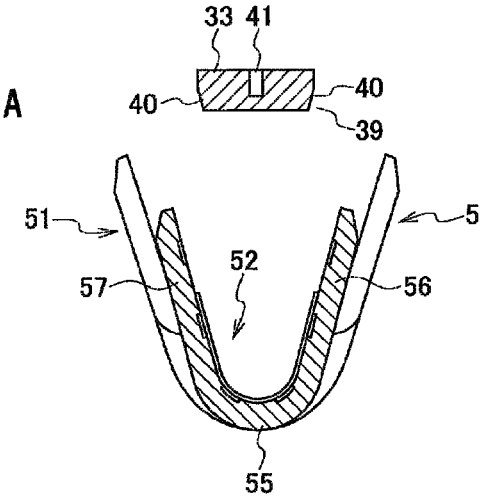
FIG. 8A is a cross-sectional view at the cross-section along the VIII-VIII line in FIG. 7 in a state before the swaging of the fourth embodiment.
Figure 8B:
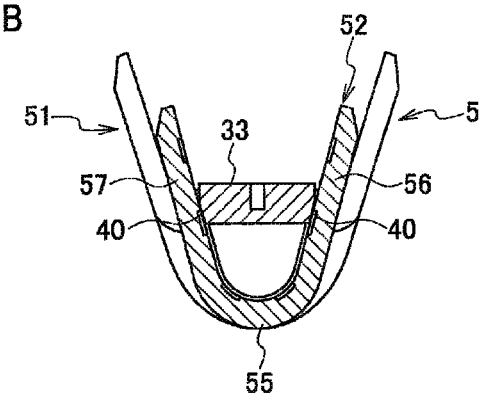
FIG. 8B is a cross-sectional view at the cross-section along the VIII-VIII line in FIG. 7 in a swaged state of the fourth embodiment.

FIG. 7, FIG. 8A and FIG. 8B show the connection structure 1 of a fourth embodiment of the present invention. FIG. 7 shows the connection structure in state of being viewed from the plane, in which the one-side side wall 56 and the other-side side wall 57 in the bus bar-swaging part 52 of the terminal 5 are arranged so as to sandwich the bus bar-crimping part 33.

Meanwhile, in the upper face of the bus bar-crimping part 33, a slit 41 is formed in the length direction, and at the bus bar-swaging part 52, the core wire connection part 54 and the insulating coating connection part 53 are formed integrally.

FIG. 8A and FIG. 8B show a procedure when swaging the bus bar-swaging part 52 of the terminal 5 to the bus bar-crimping part 33. FIG. 8A is a cross-sectional view at the cross-section along the VIII-VIII line in FIG. 7 in a state before the swaging, and FIG. 8B is a cross-sectional view in a swaged state after the swaging of the bus bar-swaging part 52, proceeding from the state in FIG. 8A.

The bus bar-crimping part 33 of the present embodiment is in a plate shape, and the side-face part of the bus bar-crimping part 33 serves as the posture-retaining face 40. The posture-retaining face 40 is formed of a tapered plane in which the interval decreases gradually along the direction from the upside to the downside.

When swaging the bus bar-swaging part 52 to the bus bar-crimping part 33, the side walls 56 and 57 of the bus bar-swaging part 52 are bent in a mutually approaching direction. In the bending, the side walls 56 and 57 of the bus bar-swaging part make surface-contact, from the side face, with the posture-retaining face 40 of the side part of the bus bar-crimping part 33 having a tapered plane. Consequently, the posture of the bus bar-crimping part 33 can be retained, and contact properties of the bus bar-crimping part 33 with the bus bar-swaging part 52 can be enhanced. Accordingly, the inclination of the bus bar-crimping part 33 at the time of the swaging can be prevented, and poor contact pressure and biting caused by the inclination are avoided. Consequently, the reliability on the connection can be enhanced.

Furthermore, since the slit 41 is formed in the upper face of the bus bar-crimping part 33 in the length direction, when bending the side walls 56 and 57 of the bus bar-swaging part 52 in the mutually approaching direction, the bus bar-crimping part 33 is bent easily with the slit 41 as the center. As the result of the bending, the bus bar-crimping part 33 is deformed so that the lower face of the bus bar-crimping part 33 protrudes toward the arc-shaped bottom wall 55 of the bus bar-swaging part 52, and contact properties of the bus bar-crimping part 33 with the bus bar-swaging part 52 can be enhanced. That is, by forming the slit 41 in the upper face of the bus bar-crimping part 33, the inclination of the bus bar-crimping part 33 at the time of the swaging is prevented and poor contact pressure and biting caused by the inclination are avoided. Consequently, the reliability on the connection can be enhanced.

<Fifth Embodiment>

FIG. 9, FIG. 10, FIG. 11A and FIG. 11B show the connection structure 1 of a fifth embodiment of the present invention.

Figure 9:
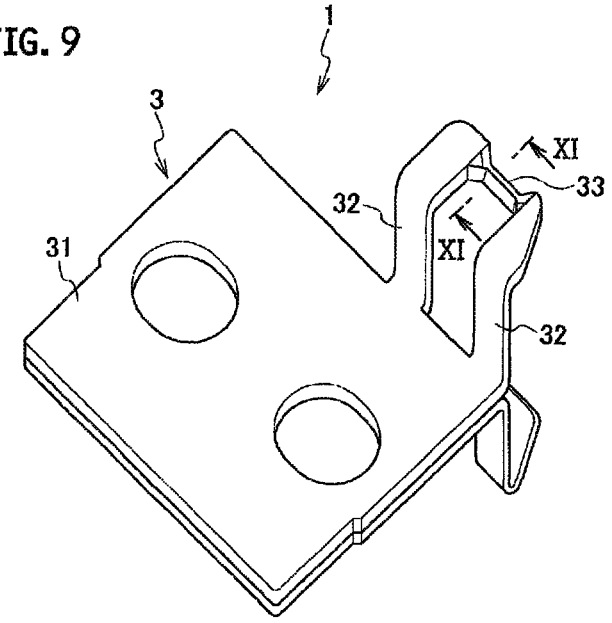
FIG. 9 is a perspective view showing the bus bar of a fifth embodiment of the present invention.
Figure 10:
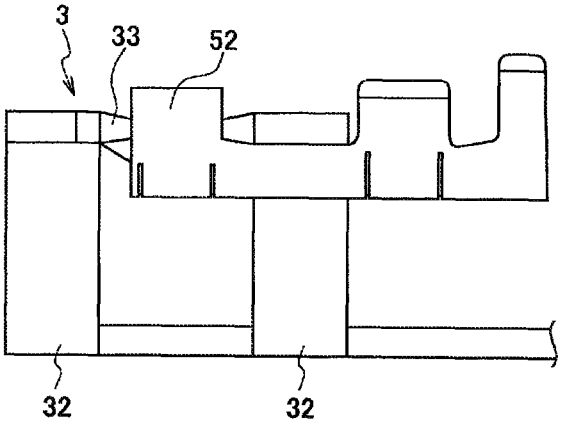
FIG. 10 is side view showing a state where the bus bar-crimping part is disposed at the bus bar-swaging part of a terminal in the fifth embodiment of the present invention.

FIG. 9 is a perspective view showing the bus bar 3, and FIG. 10 is a side view showing a state when disposing the bus bar-crimping part 33 at the bus bar-swaging part 52 of the terminal 5. As shown in FIG. 9 and FIG. 10, in the bus bar 3, the pair of connection ends 32 is provided under an orthostatic condition from the bus bar main body 31 in a plate shape, and the bus bar-crimping part 33 is laid across the connection ends 32.

Figure 11A:
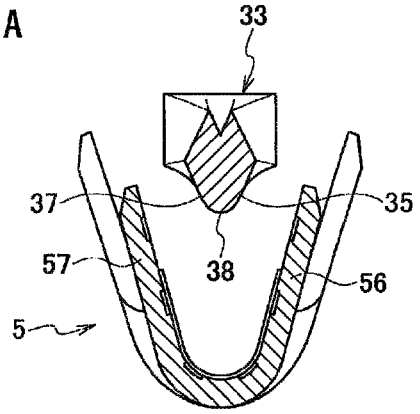
FIG. 11A is a cross-sectional view at the cross-section along the XI-XI line in FIG. 9 in a state before the swaging in the fifth embodiment.

FIG. 11A is a cross-sectional view at the cross-section along the XI-XI line in FIG. 9 in a state before the swaging. As shown in FIG. 11A, the bus bar-crimping part 33 is coupled by the one-side contact piece 35, the other-side contact piece 37 and the coupling-contact piece 38. In FIG. 11A, the bus bar-crimping part 33 is bent in a V-letter shape, and consequently, the coupling-contact piece 38 is bent at an acute angle, and the one-side contact piece 35 and the other-side contact piece 37 coupled to the coupling-contact piece 38 are flat surfaces.

When bending the side walls 56 and 57 of the bus bar-swaging part 52 in the mutually approaching direction and swaging the bus bar-swaging part 52 to the bus bar-crimping part 33, the side walls 56 and 57 of the bus bar-swaging part 52 make surface-contact with the contact pieces 35 and 37 that are inclined planes. As the result, the posture of the bus bar-crimping part 33 can be retained and contact properties of the bus bar-crimping part 33 with the bus bar-swaging part 52 can be enhanced. Consequently, the inclination of the bus bar-crimping part 33 at the time of the swaging can be prevented, and poor contact pressure and biting caused by the inclination are avoided. Accordingly, the reliability on the connection can be enhanced.

Figure 11B:
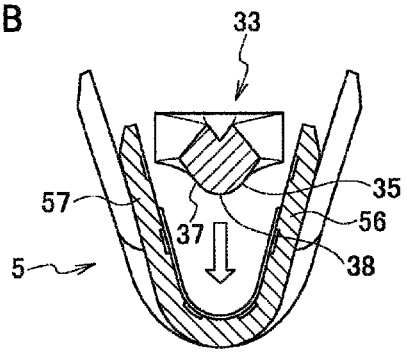
FIG. 11B is a cross-sectional view at the cross-section along the XI-XI line in FIG. 9 in a state before the swaging in a modified example of the fifth embodiment.

FIG. 11B shows a cross-sectional view in a modification obtained from the example shown in FIG. 11A. As compared with FIG. 11A, the bending of the coupling-contact piece 38 is gentler, and the entire bus bar-crimping part 33 including the one-side contact piece 35 and the other-side contact piece 37 is in a U-letter shape. Also in this case, since the one-side contact piece 35 and the other-side contact piece 37 are in inclined planes, when swaging the bus bar-swaging part 52, the side walls 56 and 57 of the bus bar-swaging part 52 make surface-contact with these contact pieces 35 and 37. Therefore, the posture of the bus bar-crimping part 33 can be retained and contact properties of the bus bar-crimping part 33 with the bus bar-swaging part 52 can be enhanced. Consequently, the inclination of the bus bar-crimping part 33 at the time of the swaging can be prevented and poor contact pressure and biting caused by the inclination are avoided. Accordingly, the reliability on the connection can be enhanced.

<Sixth Embodiment>

Figure 12A:
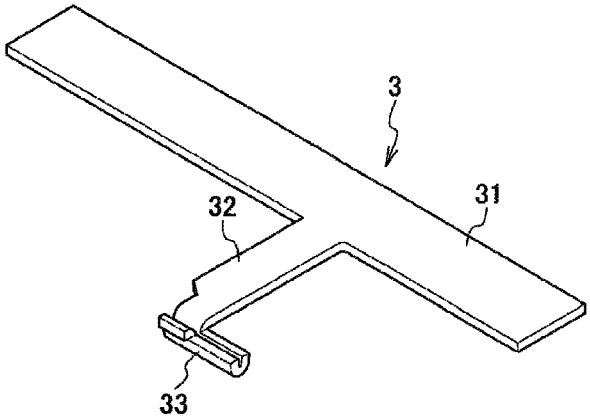
FIG. 12A is a perspective view showing the bus bar in a sixth embodiment of the present invention.
Figure 12B:
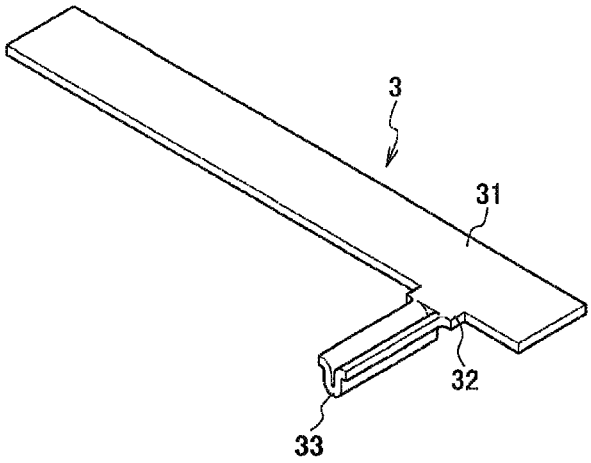
FIG. 12B is a perspective view showing the bus bar in a modified example of the sixth embodiment of the present invention.

FIG. 12A and FIG. 12B each represents a different form of the bus bar 3 for use in the connection structure of the present invention.

In these forms, in the bus bar main body 31, one connection end 32 is formed integrally, and to the connection end 32, the bus bar-crimping part 33 is provided continuously. In FIG. 12A, the bus bar-crimping part 33 extends in the direction orthogonal to the connection end 32. In contrast, FIG. 12B shows a modification obtained from the example shown in FIG. 12A, and in FIG. 12B, the bus bar-crimping part 33 extends in the same direction as the connection end 32. Also in these bus bar-crimping parts 33, by setting the same structure as that in above-mentioned embodiment, the surface contact with the bus bar-swaging part 52 becomes possible and the reliability on the connection can be enhanced.

Hereinbefore, embodiments of the present invention have been explained, but these embodiments are mere exemplifications described for making the understanding of the present invention easy, and the present invention is not limited to these embodiments. The technical scope of the present invention is not limited to specific technical items disclosed in above-mentioned embodiments, but also includes various modifications, changes, alternative technologies etc. that can be derived from the items.

This application claims for priority based on Japanese Patent Application NO. 2013-022834 filed on Feb. 8, 2013, the entire content of which is hereby incorporated by reference.

INDUSTRIAL APPLICABILITY

By providing, to a bus bar-crimping part, a crimping posture-retaining part that retains the crimping posture of the bus bar-crimping part at the time of crimping a bus bar-swaging part to the bus bar-crimping part, the crimping posture of the bus bar-crimping part is not inclined when swaging the bus bar-swaging part, and defective crimping such as poor contact pressure or biting is prevented. Therefore, the reliability on the connection can be enhanced.

1 connection structure
3 bus bar
5 terminal
31 bus bar main body
33 bus bar-crimping part
34 base part
35 one-side contact piece
37 other-side contact piece
38 coupling-contact piece 38
39 crimping posture-retaining part
40 posture-retaining face
52 bus bar-swaging part
55 bottom wall
56 one-side side wall
57 other-side side wall

What is claimed is:

1. A connection structure of a bus bar and a terminal of an electric wire end for electrically connecting the bus bar that connects a plurality of apparatuses to each other, with the terminal of the electric wire end, wherein:

the bus bar is formed of a bus bar main body that connects with the plurality of apparatuses with each other, and a bus bar-crimping part which is formed integrally with the bus bar main body, and to which the terminal is connected in a crimped manner;

the terminal is formed of an electric wire connection part to which the electric wire end is electrically connected, and a bus bar-swaging part connected to the bus bar-crimping part;

a crimping posture-retaining part for retaining a crimping posture of the bus bar-crimping part when crimping the bus bar-swaging part to the bus bar-crimping part is provided at the bus bar-crimping part; and a connection end extending from the bus bar main body and substantially perpendicularly connected to the bus-bar crimping part.

2. The connection structure of a bus bar and a terminal according to claim 1, wherein:

the bus bar-swaging part is formed of an arc-shaped bottom wall and a pair of side walls that are provided extending from both side parts of the bottom wall in the same direction and that are bent in a mutually approaching direction when swaging the bus bar-swaging part to encompass the bus bar-crimping part; and the crimping posture-retaining part is a posture-retaining face that is provided at the bus bar-crimping part and that is supported by at least one of the pair of side walls when swaging the bus bar-swaging part to the bus bar-crimping part.

3. The connection structure of a bus bar and a terminal according to claim 2, wherein:

the posture-retaining face is a flat face or a curved face that makes surface-contact with at least one of the pair of side walls.

4. The connection structure of a bus bar and a terminal according to claim 2, wherein:

the bus bar-crimping part is formed in a U-letter shape by a base part provided extending from the bus bar main body, a one-side contact piece that is provided extending from the base part to make contact with one side wall of the pair of side walls, an other-side contact piece that makes contact with the other side wall, and a coupling-contact piece that couples the one-side contact piece and the other-side contact piece; and the posture-retaining face is formed on at least the coupling-contact piece.

5. The connection structure of a bus bar and a terminal according to claim 2, wherein:

the bus bar-crimping part is formed in a plate shape, and at the side-face part of the bus bar-crimping part in a plate shape, the posture-retaining face that makes surface-contact with the pair of side walls when swaging the bus bar-swaging part to the bus bar-crimping part is formed.

* * * * *